US007325259B2

(12) United States Patent
Wood

(10) Patent No.: US 7,325,259 B2
(45) Date of Patent: Feb. 5, 2008

(54) APPARATUS FOR EXTENDING AND RETRACTING A POOL COVER

(75) Inventor: Charles F. Wood, Peoria, AZ (US)

(73) Assignee: Sun Systems, Inc., Phoenix, AZ (US)

( * ) Notice: Subject to any disclaimer, the term of this patent is extended or adjusted under 35 U.S.C. 154(b) by 398 days.

(21) Appl. No.: 10/978,000

(22) Filed: Oct. 29, 2004

(65) Prior Publication Data

US 2005/0102744 A1 May 19, 2005

Related U.S. Application Data

(60) Provisional application No. 60/517,147, filed on Nov. 4, 2003.

(51) Int. Cl.
*E04H 4/00* (2006.01)

(52) U.S. Cl. ..... 4/502

(58) Field of Classification Search ..... 4/502; 242/388.6

See application file for complete search history.

(56) References Cited

U.S. PATENT DOCUMENTS 5,105,481 A * 4/1992 Lamb et al. ..... 4/502
5,920,922 A * 7/1999 Ragsdale et al. ..... 4/502
6,431,488 B1 * 8/2002 Zemla et al. ..... 242/388.6

* cited by examiner

*Primary Examiner*—Charles E. Phillips
(74) *Attorney, Agent, or Firm*—Cahill, von Hellens & Glazer PLC

(57) ABSTRACT

Apparatus for extending and retracting a cover for a swimming pool includes a motor for selectively rotating a clutch in one direction or the other direction. A first pawl, extending within the clutch, drives a first cam to cause rotation of a set of pulleys for winding cords thereabout to extend the cover from about a roller and a second pawl, extending within the clutch, drives a second cam to cause rotation of the roller to wrap the cover thereabout. First and second lift arms lift the first and second pawls out of engagement with the first and second cams, respectively as a function of the direction of rotation of the clutch to ensure that only one of the first and second cams is rotated by the clutch. A cylinder mounted on a shaft in engagement with the armature of the motor is in frictional contact with spring loaded brakes within the clutch to transfer rotational movement of the armature to the clutch. A compensator in engagement with the cords, through pulleys therewithin and spools therewithout, compensates for changes in relative length of the cords over time and for lack of squareness of the pool.

21 Claims, 8 Drawing Sheets

APPARATUS FOR EXTENDING AND RETRACTING A POOL COVER

CROSS REFERENCE TO RELATED APPLICATIONS

The present application relates to and claims priority to a provisional application entitled "APPARATUS FOR EXTENDING AND RETRACTING A POOL COVER" filed Nov. 4, 2003 and assigned Ser. No. 60/517,147 describing and illustrating a related invention made by the present inventor and assigned to the present assignee.

BACKGROUND OF THE INVENTION

1. Field of the Invention

The present invention relates to swimming pool cover extension and retraction systems and, more particularly, to a clutch for selectively actuating cords to extend the cover or a roller to retract the cover and having a compensator for accommodating for changes in relative length of the cords over time or as a function of the squareness of the pool.

2. Description of Related Prior Art

Particularly residential swimming pools are not in constant use with adult supervision. During such periods of non use, a swimming pool is in the nature of an attractive nuisance to the extent that children may play with the water or float toys on the water whether such children are by the side of the pool or actually in the pool. Without adult supervision, such children may come to harm by falling into the pool or by panicking when in the pool. To reduce the likelihood of harm to such children, many jurisdictions require a childproof fence be erected about the pool and having a latching gate not operable by a child. Such fences are generally unsightly and often not sufficiently effective to keep children away from the pool.

To alleviate the burden of having to erect a fence about a residential pool, various manufacturers provide covers for swimming pools that may be installed or removed with more or less difficulty. Many of these covers are of plastic impregnated canvas that must be unfolded and dragged across the pool with subsequent attachment to the sides of the pool. Generally, two or more persons are needed to effect this task. To uncover the pool, this process is reversed. Thereafter, a storage place must be available for the rather bulky folded cover. Because of the work involved in securing, removing and storing pool covers of this type, they have found little popularity.

Automated pool cover extension and retraction systems have been available for a period of years. Such systems generally include a roller rotatably mounted at one end of a pool from which a cover is extended across a pool by motor driven pulleys retracting cords attached to the end of the cover. Retraction is achieved by rotating the roller to wind the cover thereof. Previously used mechanisms for accomplishing these results generally tend to be bulky, incorporate a plurality of parts and fixtures and require significant maintenance efforts to operate satisfactorily. Furthermore, the extension apparatus generally includes two cords attached to opposed sides of the free end of the cover. The length of these two cords is different and over time one cord will stretch more than the other. Unless such change in relative length is addressed by the apparatus, the cover will become skewed and effective operation will be compromised. Moreover, the winding of the cords upon a common pulley or upon separate pulleys will not be uniform and one cord may become wrapped about its pulley more quickly than the other cord, also resulting in skewing of the cover. As both the pulley(s) and the roller must be motor driven, two separate motors have been used to avoid the mechanical complexity of having a single motor selectively driving both the pulley(s) and the roller.

Aside from the safety issues attendant extending a pool cover across a pool during non use, several practical benefits are also achieved. First, such a cover prevents leaves and other debris from falling into the pool. Whatever debris may come to rest upon the cover is relatively easily removed as most pool covers can be walked upon by a person.

In climates where a pool is heated, a pool cover serves a very beneficial purpose of retaining the heat. That is, the cover prevents heat transfer from the water of the pool by radiation and by convection. Furthermore, evaporation as a result of wind blowing there across, another element of heat loss, is essentially avoided. Thereby, the costs of heating a pool are significantly reduced by such reduction of heat loss.

Finally, for safety reasons, a pool cover should be sufficiently robust to permit an adult to walk there across without fear of the pool cover ripping and resulting in the person falling there through. Obviously, such strength embodied in the pool cover will prevent any child venturing onto the pool cover from falling into the water and drowning.

SUMMARY OF THE INVENTION

A cord and pulley mechanism is actuated by at least one pulley and preferably a pair of pulleys serving as take-up pulleys to wrap one or a pair of cords thereabout to bring about extension across a pool of a pool cover wrapped about a freewheeling roller. The roller, having the pool cover wrapped thereabout, is freewheeling in one direction to accommodate extension of the pool cover. The roller is rotated in the other direction to wrap the pool cover thereabout during retraction of the pool cover. The pair of pulleys are freewheeling to permit unwrapping of the cords. Tracks disposed on opposed sides of the pool slidably house the cords and the opposed edges of the pool cover during extension and retraction of the pool cover.

More particularly, an armature of an electric motor turns a connected shaft in either a first or a second direction. A cylinder of phenolic or like material is supported on and keyed to the shaft to rotate in response to rotation of the shaft. A clutch includes two spring loaded brake shoes that capture the cylinder there between, and that are in frictional engagement with the cylinder. The degree of frictional engagement may be set by set screws bearing against springs in contact with the brake shoes. A pair of oppositely oriented pawls are pivotally mounted within the clutch. A first cam, rigidly connected to the pair of pulleys, is in operative engagement with a first pawl of the pair of pawls. Upon rotation of the clutch in a first direction, the first pawl will engage the first cam to cause rotation of the pair of pulleys in the first direction to wrap the cords thereabout and cause extension of the pool cover. Rotation of the clutch in a second direction will cause a first lift arm to disengage the first pawl with the first cam and the pair of pulleys freewheel as the cords are unwound therefrom. A second cam, rigidly connected to the roller about which the pool cover is wrapped and unwrapped, is in selective engagement with a second pawl of the pair of pawls. When the clutch rotates in the second direction, the second pawl will engage the second cam to cause rotation of the roller and wind the pool cover thereabout. Subsequent rotation of the clutch in the first direction will cause a second lift arm to disengage the second pawl from the second cam and permit the roller to freewheel as the cords become wound about the pair of pulleys and unwrap the cover from about the roller. In the event of a jam or obstruction to movement of the cords or the pool cover, slippage between the cylinder and the clutch assembly will result to prevent damage or injury.

A compensator for changes in cord length over time or due to lack of squareness of the pool is in engagement with both cords proximate the pair of pulleys. Through a series of pulleys and spools within and without the compensator the operative length of the cords of the cords is automatically adjusted through repositioning of the compensator.

In operation, actuation of the electric motor to extend the pool cover across the pool will result in rotation of the clutch in the first direction to wind the cords upon the pulleys, which cords, through the cord and pulley mechanism, will draw the cover from about the roller. During this operation, the roller may freewheel to permit unwrapping of the pool cover. To retract the pool cover, the electric motor is caused to rotate in the second direction to wrap the pool cover about the roller. Simultaneously, the pulleys are freewheeling to permit unwinding of the cords attached to the pool cover via the cords and pulley mechanism.

It is therefore a primary object of the present invention to provide an extension and retraction apparatus for a pool cover.

Another objection of the present invention is to provide a set of pulleys for extending a pool cover during operation of a motor in one direction and a roller for wrapping the pool cover thereabout during retraction and operative when the motor is turning in the other direction.

Still another objection of the present invention is to provide a compensator to compensate for changes in cord length over time or as a result of lack of squareness of the pool during extension and retraction of a pool cover.

Yet another object of the present invention is to provide a motor driven clutch for operating a pair of pulleys to wrap cords thereabout during extension of a pool cover when the motor turns in one direction and a roller for wrapping the pool cover thereabout when the motor turns in the other direction during retraction of the pool cover.

A further object of the present invention is to provide a clutch having a first pawl pivotally mounted therein to drive a first cam to rotate a pair of pulleys to extend a pool cover and a second pivotally mounted pawl for driving a second cam to rotate a roller to retract the pool cover.

A still further object of the present invention is to provide a pool cover apparatus having a motor driven clutch selectively actuating a pair of pulleys or a roller as a function of the direction of rotation of the motor.

A yet further object of the present invention is to provide a pool cover apparatus with a floating compensator automatically repositionable to compensate for a change in operative length of a pair of cords for extending a pool cover.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENTS

Figure 1:
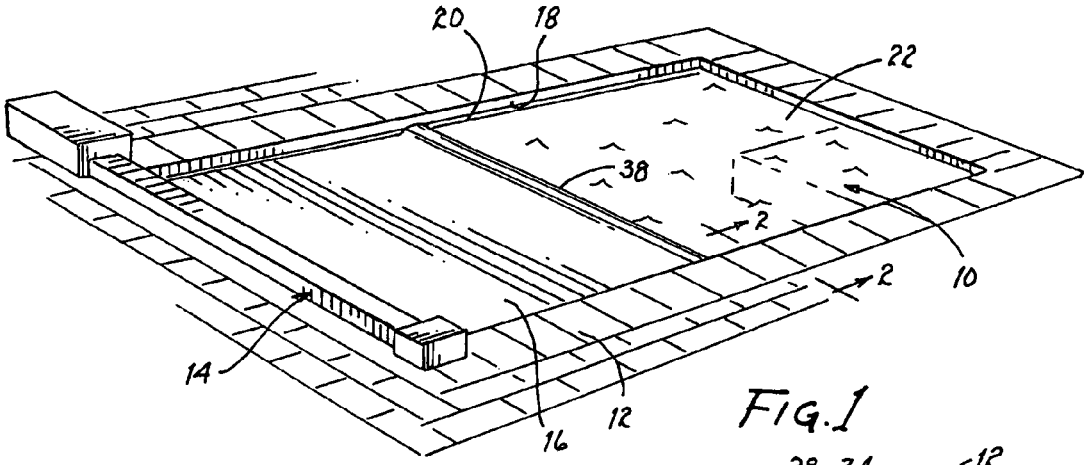
FIG. 1 illustrates a representative swimming pool having an apparatus for extending and retracting a cover there across.

Referring to FIG. 1, there is illustrated a representative swimming pool 10 of the type commonly found in the backyards of residences. As shown, the pool is essentially rectangular in plan form and includes a surrounding deck 12. A pool cover extension and retraction apparatus 14 conforming with the present invention is located at one end of the pool, which may be the deep end. A pool cover 16 extending from apparatus 14 is shown as partially extending across pool 10. That is, this pool cover may be in the process of being extended or retracted upon operation of apparatus 14.

Figure 2:
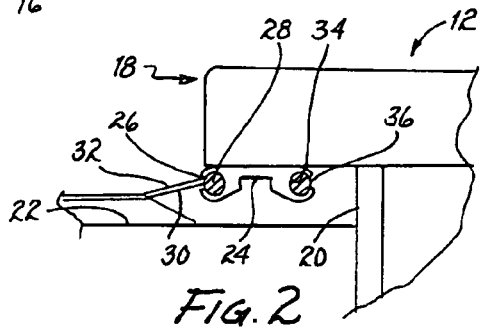
FIG. 2 illustrates a cross sectional view of the coping of a pool supporting guides for the cover and a cord attached to the edge of the cover.

Generally, deck 12 includes a lip 18, referred to as a coping in the trade, as shown in FIG. 2, extending past each wall 20 of the pool and over water 22 in the pool. A track 24 is mounted beneath coping 18 and serves two functions. First, a slot or keyway 26 houses a rope 28 attached to edge 30 of cover 32. Thereby, the longitudinal edges of the cover are retained adjacent the lower side of coping 18 along the sides of the pool. A further keyway 34 slidably houses a cord 36 used to draw edge 38 (see FIG. 1) of cover 16 to the end of the pool opposite that of apparatus 14. Thereby, cover 16 is essentially adjacent the bottom of coping 18 and minimal space exists between the cover and the coping to minimize passage of debris of other foreign matter between the cover and the side of the pool.

Figure 4:
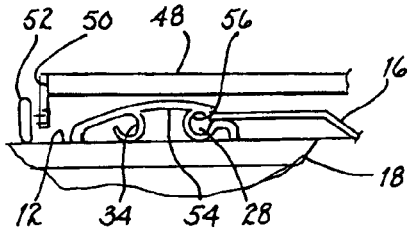
FIG. 4 illustrates a roller supporting the edge of the cover and the guide for the cords attendant the cover.
Figure 3:
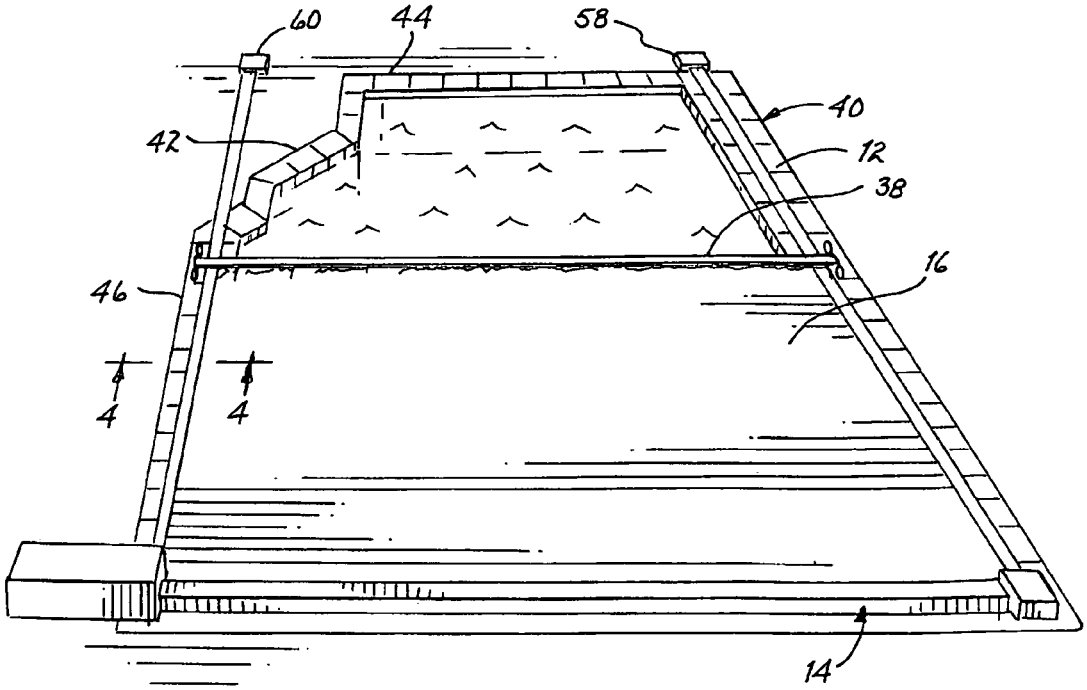
FIG. 3 illustrates a cover supported by rollers supporting the edge of the cover upon the deck surrounding the pool.

FIG. 3 illustrates a non rectangular or non conventionally shaped pool 40. Because of the unconventional shape of the pool, as represented by section 42 disposed between end 44 and side 46, a track 24 of the type shown in FIG. 2 cannot be used to guide cover 16 during retraction and extension nor for the purpose of maintaining the extended cover essentially adjacent with the sides of pool 40. For this reason, a modified form of the track is used, as illustrated in FIG. 4. Edge 38 of cover 16 may include a rod 48 extending past the opposed edges of deck 12. Each end 50 of rod 48 is supported above the deck by a wheel 52 to provide space between deck 12 and rod 48. A track 54 is mounted on deck 12 between coping 18 and wheel 52. Track 54 serves the same purpose as track 24 (see FIG. 2). That is, the track includes a keyway 56 for slidably retaining rope 28 located at the side of cover 16. A further keyway 34 (shown empty) supports and guides a cord ultimately attached to edge 38 of cover 16, which cord is used to extend the cover across the pool. As particularly shown in FIG. 3, deck 12 on the right hand side includes a straight edge and supports the corresponding end of rod 48 via its wheels. In view of the indentation represented by section 42 on the left hand side of the pool, a surface extending toward end 44 must be provided to support the wheels at the left end of rod 48. A pair of caps 58, 60 house return pulleys for the cords used to extend and retract cover 16 across the pool.

Figure 5:
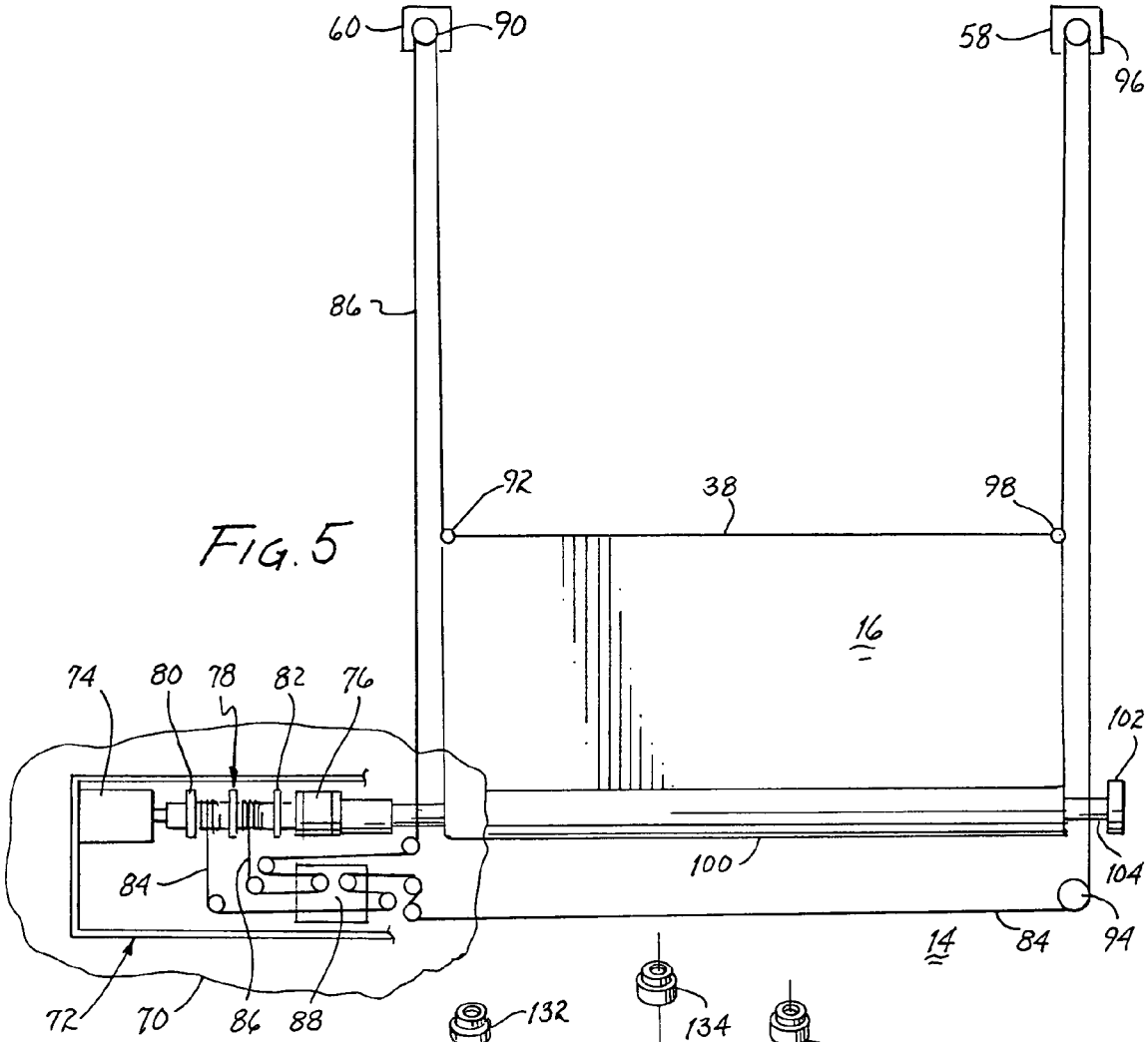
FIG. 5 is a representative top view of a pool having the present invention mounted thereon and includes a cutaway view illustrating the routing of the cords.

Referring to FIG. 5 and subsequent figures, details of the pool cover extension and retraction apparatus (14) will be described in detail. As shown within dashed line 70, motive means 72 for urging extension and retraction of cover 16 will be generally described. An electric motor 74 rotates a clutch 76 in one direction or the other, depending upon whether the cover is to be extended or retracted. During extension of the cover, a set of pulleys 78 represented by pulleys 80, 82 rotate to wind cords 84, 86 thereabout. These cords wind about various pulleys and spools, and compensator 88 for ultimate connection with edge 38 of cover 16 as will be described. In particular, cord 86 extends, via one of tracks 54, as described above, to return pulley 90 within cap 60 and thereafter is interconnected with edge 38 through a suitable connector 92. Cord 84 extends about spool 94 to return pulley 96 located within cap 58. Thence it is connected to edge 38 of the cover through a connector 98.

To retract the pool cover, motor 74 is rotated in the opposite direction and clutch 76 interconnects roller 100 to cause the roller to rotate and wrap cover 16 thereabout during retraction of the cover. During such retraction, set of pulleys 78 are freewheeling to permit withdrawal of cords 84, 86 from thereabout. Similarly, as set of pulleys 78 draw cords 84, 86 thereabout, roller 100 is freewheeling to accommodate extension of cover 16. Necessarily, suitable bearing surfaces are employed to rotatably support the various elements of apparatus 14, such as a bearing located within a mounting 102 to rotatably support shaft 104.

Figure 6:
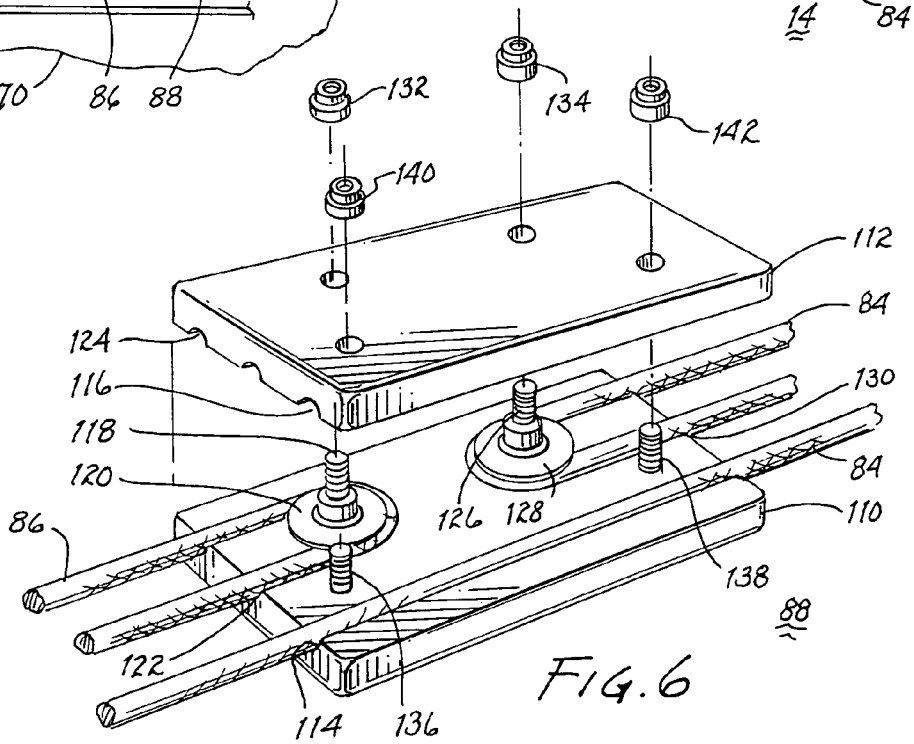
FIG. 6 is an exploded view illustrating a compensator for the cords.

Referring to FIG. 6, the structural details of compensator 88 will be described. Its mode of operation will be particularly described below primarily with respect to FIG. 7A. The compensator may be formed of two plates of low friction material, such as that sold under the trademark Delrin. Plates 110 and 112 include grooves 114, 116, respectively, for slidably retaining cord 84. A post 118 extends from plate 110 and supports a pulley 120 within an indentation. A U shaped groove 122 around pulley 120 is formed in the plate to accommodate sliding movement therewithin of cord 86. Plate 112 includes a similar U shaped groove 124 and a related indentation for accommodating pulley 120. A further post 126 extends from plate 110 to support a pulley 128 within an indentation. A further U shaped groove around pulley 128 is formed in the plate to accommodate sliding passage of cord 84 there through. A similar U shaped groove and indentation for pulley 128 is formed in plate 112 (not shown). Nuts 132, 134, engage posts 118, 126, respectively, to secure plate 112 with plate 110. Further posts 136, 138 may be employed in combination with nuts 140, 142 to add further rigidity and stability to compensator 88. It is to be understood that these posts may, in fact, be bolts extending from the underside of plate 110.

Figure 7:
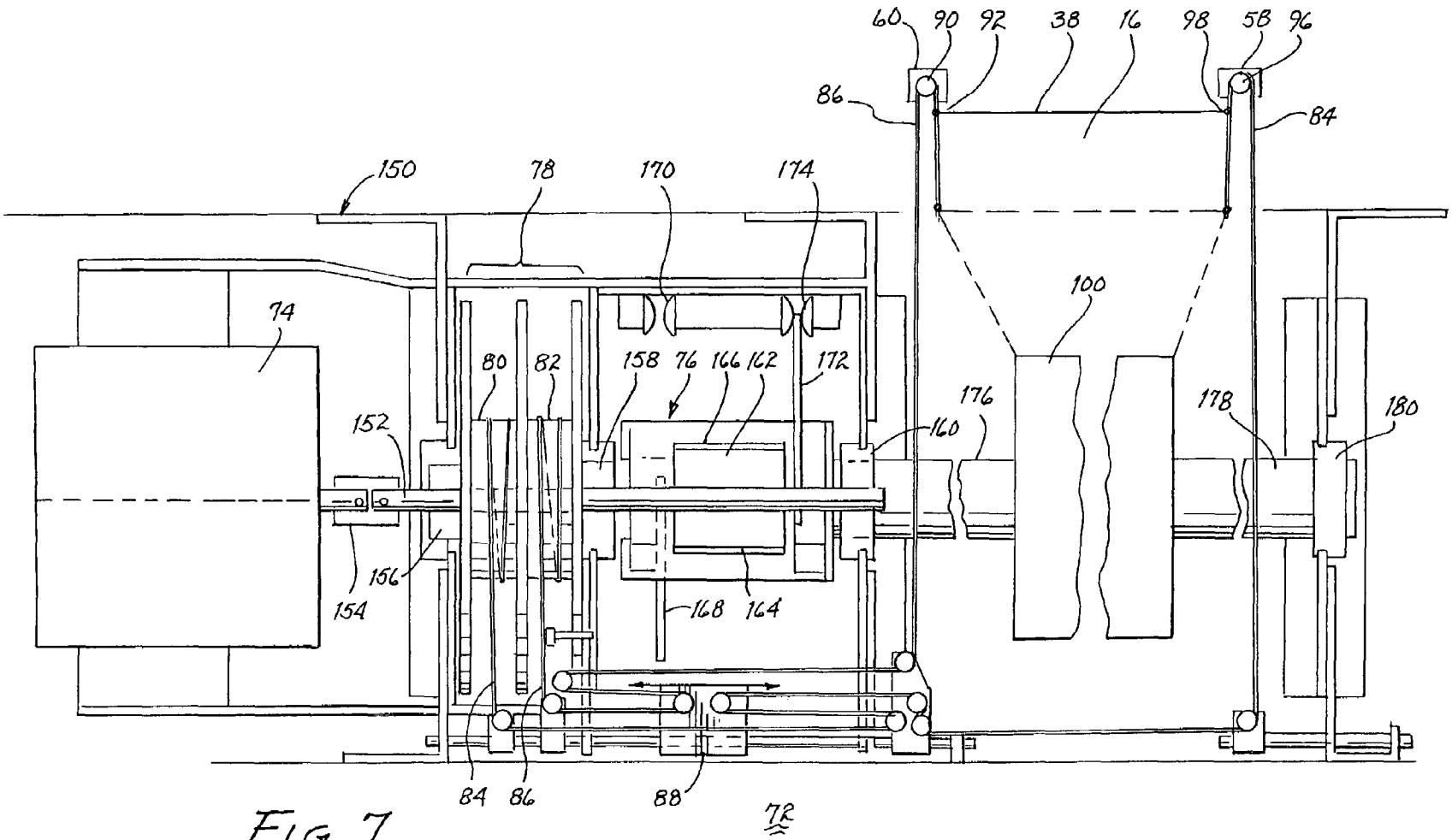
FIG. 7 is a top view illustrating the layout of the cords, motor, clutch and roller.

Referring to FIG. 7, motive means 72 (shown in FIG. 5) will be described in further detail. A multi-component frame collectively referred to by reference numeral 150 supports the various components directly or through bearings supporting rotary of linearly translating elements. The armature of motor 74 is coupled to shaft 152 through a coupling 154. The shaft is supported upon bearings 156, 158 and 160 lodged within elements of frame 150. A cylinder 162 is non rotatably mounted on shaft 152 to turn as the shaft turns. A pair of brake shoes 164, 166 are coupled with clutch 76 to bear against cylinder 162 and cause rotation of the clutch as a function of rotation of the cylinder. Pivotally mounted lift arm 168 rotates with rotation of the clutch into sliding engagement between a set of spring loaded bottoms 170. The pivotal movement of the lift arm is limited and upon such pivotal movement, the lift arm will bring a pawl into or out of engagement with a cam coupled to set of pulleys 78, depending upon the direction of rotation of clutch 76. A further lift arm 172 is pivotally mounted with and extends from clutch 76 and into repetitive engagement with a further set of spring loaded buttons 174. Lift arm 172 has limited pivotal movement and movement in one direction or the other will either bring a pawl into or out of engagement with a cam coupled to a spindle 176 supporting roller 100. A further spindle 178 extends from the roller and is rotatably supported within a bearing 180 mounted in a part of frame 150. It is to be noted that cover 16 is only representatively illustrated as the operation to extend and retract the cover is more fully described with respect to FIG. 5.

Figure 7A:
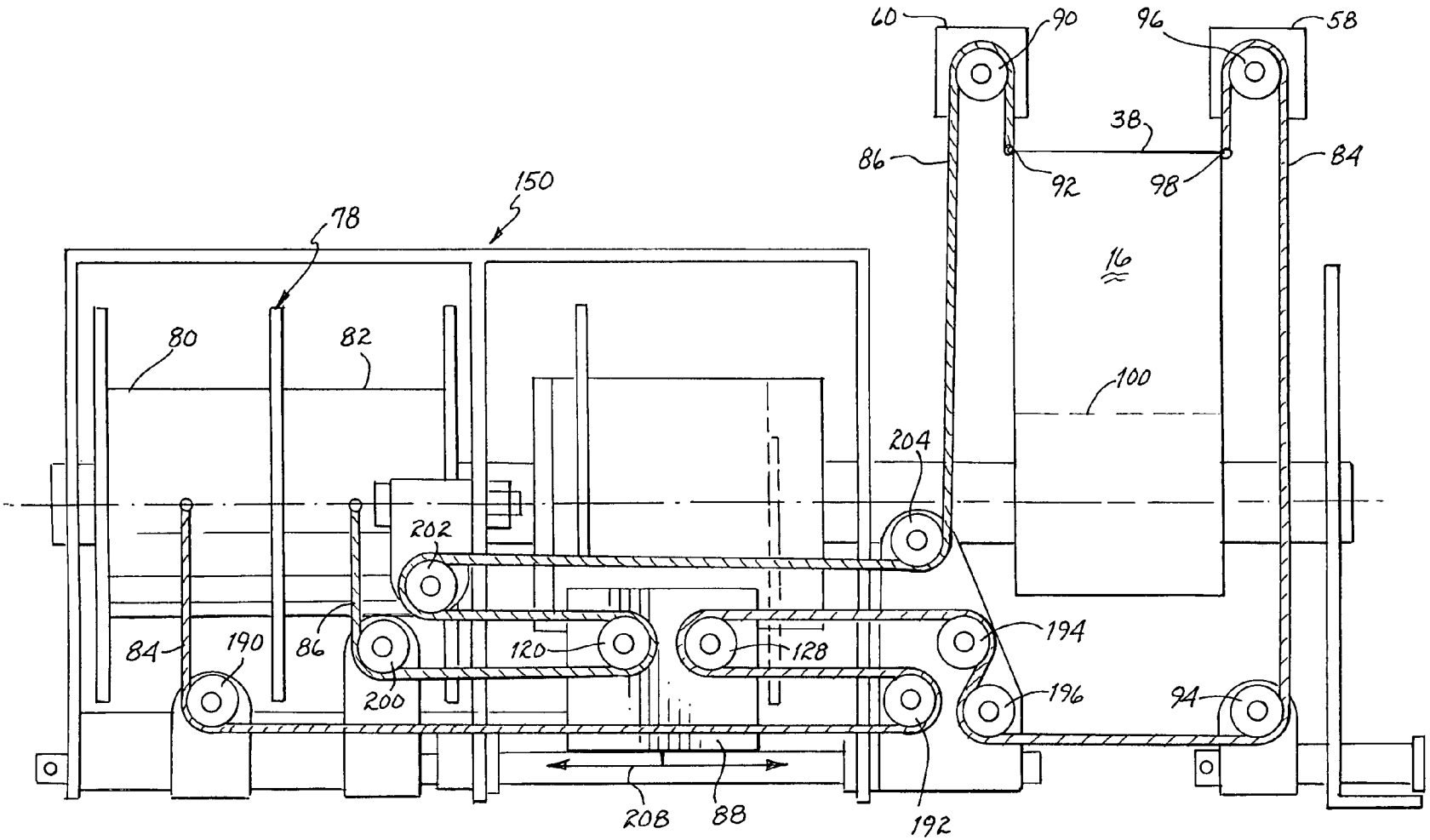
FIG. 7A is a detail view illustrating the layout of the cords.

Referring to FIG. 7A, the convolutions and operation of cords 84, 86 will be described in detail along with compensator 88. Cord 84 extends from about pulley 80 of set pulleys 78 and partly about spool 190 rotatably mounted on an element of frame 150. The cord slidably extends through grooves 114, 116 (see FIG. 6) in compensator 88 to a further spool 192 rotatably mounted on frame 150. The purpose of spool 192 is that of reversing the direction of cord 84 back into compensator 88 about pulley 128 and back out of the compensator. Thereafter, cord 84 extends about spools 194 and 196, rotatably mounted upon an element of frame 150 to align the cord with spool 94 at the far end of roller 100. From spool 94, cord 84 extends through a track (see FIGS. 2 and 4) to spool 96 at the far end of pool 10 and within cap 58. The purpose of spool 96 is to reverse the direction of cord 84. Connector 98 attaches the end of the cord to the corner of cover 16 at edge 38 of the cover. Cord 86 is attached to pulley 82 of set of pulleys 78 and extends partially about spool 200 rotatably mounted upon an element of frame 150. Cord 86 extends into compensator 88 and about pulley 120 to reverse its direction. After the cord exits from the compensator, it extends about spool 202 rotatably mounted to an element of frame 150 to spool 204 mounted to an element of frame 150. Cord 86 extends from pulley 204 to and about pulley 90 to connector 92 disposed at a corner of edge 38 of cover 16.

By inspection, it becomes evident that cord 84 is of greater length than cord 86 as it extends past the length of roller 100. Over a period of time, it is expected that cords 84, 86 will become somewhat elongated, as is normal. Because the two cords are not initially of the same length, cord 84 is likely to become more elongated than cord 86. Normally, such difference in length of the cords subsequent to initial installation would create a binding or unacceptable operation during extension/retraction of the cover. By using compensator 88, such difference in elongation of the cords is compensated for, as set forth below. Assuming that cord 84 has become more elongated than cord 86, the end of edge 38 proximate connector 98 may tend to be retarded with respect to the end of the edge proximate to connector 92. At the full extension of the cover to where connector 92 comes to a stop, connector 98 will be short of the stop. Continuing rotation of set of pulleys 78 will draw less elongated cord 86 along with cord 84 and compensator 88 will move sufficiently (as depicted by arrow 208) to compensate for the lesser length of cord 86.

During retraction, set of pulleys 78 is freewheeling and the length of the cords being withdrawn from set of pulleys 78 are commensurate which will result in the compensator moving in the other direction during the initial phase of retraction. Thereby, upon subsequent extension, the compensator will again translate to accommodate the additional elongation of cord 84. The compensator also provides compensation for pools that may be somewhat out of square. That is, if connectors 92, 98 do not arrive simultaneously at the respective stops because of somewhat unequal length of the sides of the pool, the compensator will accommodate for the resulting difference in cord lengths.

Figure 8:
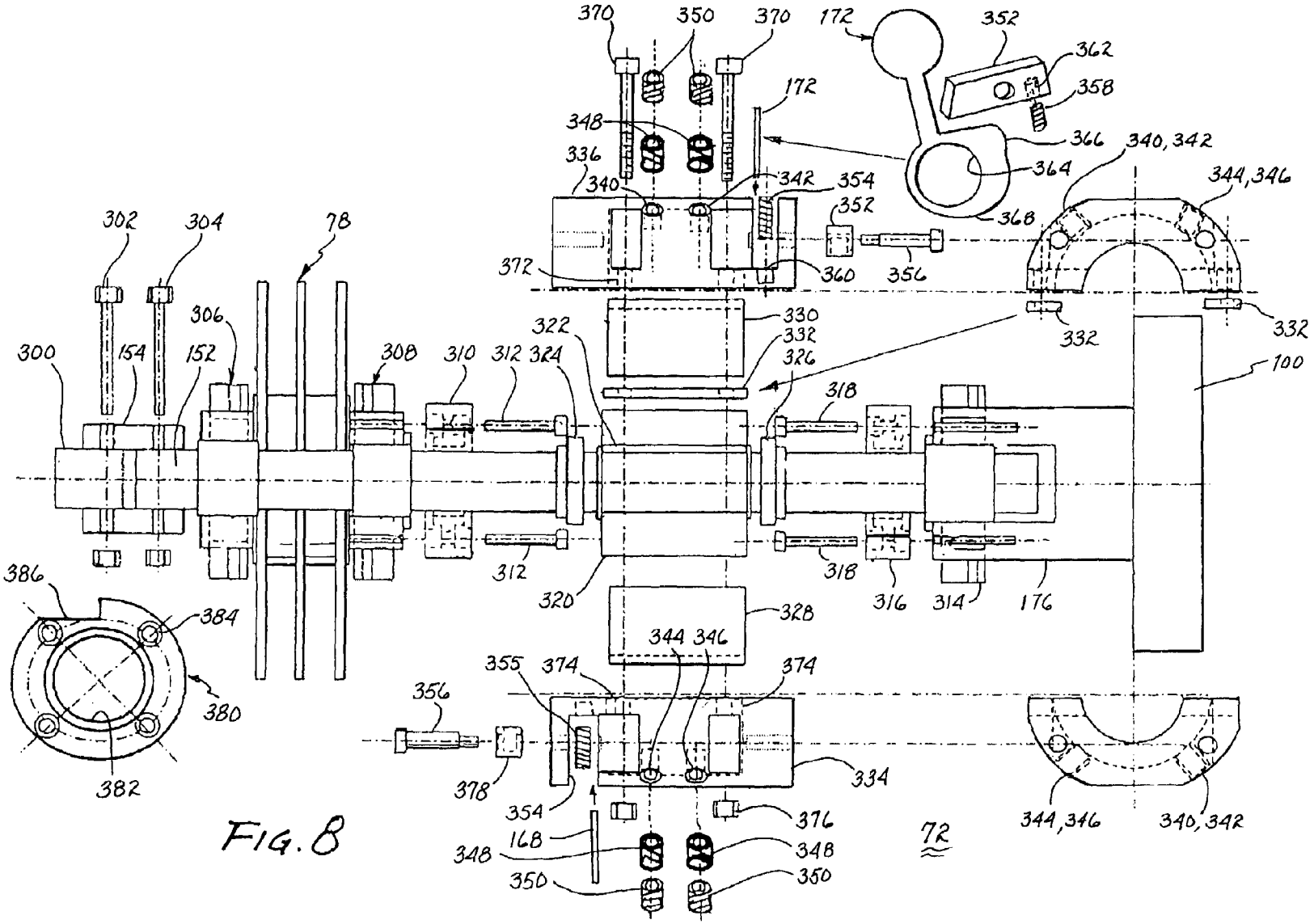
FIG. 8 is an exploded view illustrating the components of the clutch, the set of pulleys and the attachment mechanisms cooperating with the set of pulleys and a roller.

Referring to FIG. 8, further details attendant motive means 72 broadly illustrated in FIG. 5 will be described in detail. Armature 300 extending from motor 74 (see FIG. 7) is secured to coupling 154 by a bolt and nut assembly 302. A similar bolt and nut assembly 304 secures the coupling to shaft 152. A pair of bearing units 306, 308 are secured to set of pulleys 78 to rotatably mount the set of pulleys upon shaft 152. A cam 310 is secured to bearing unit 308 by bolts 312. Spindle 176, attached to roller 100, is rotatably mounted upon shaft 152 through a bearing unit 314. A cam 316 is attached to the bearing unit by bolts 318. A hollow cylinder 320 penetrably receives a shaft 152 and is locked therewith through key 322 engaging corresponding keyways in the shaft and in the cylinder. A pair of elements 324, 326 may be mounted upon shaft 152 and cooperate with bearings 158, 160 (see FIG. 7) to support the shaft on either side of cylinder 32. An opposed pair of brake shoes 328, 330 partially envelope cylinder 320, a pair of opposed bars 332 are attached to each of clutch housings 334, 336, to retain the brake shoes adjacent the respective housings and urge rotation of the housings and the clutch as a function of rotation of the cylinder.

Clutch housing 336 includes four threaded passageways 340, 342, 344 and 346 for receiving springs 348 to bear against brake shoe 330. The amount of force exerted by each of springs 348 is a function of the degree of threaded engagement of the respective one of set screws 350 in threaded engagement with the respective passageway. A pawl 354 is pivotally mounted within a slot 352 in housing 336 by a bolt 356 in threaded engagement with housing 336. A spring 358 extends from a cavity 360 at the bottom of slot 354 into a cavity 362 in the pawl to bias the pawl in one direction. A lift arm, 172 includes an aperture 364 for penetrable engagement with shaft 152 and extends outwardly through slot 154 as depicted in the figure. The lift arm includes a lobe 366, which tapers to a cylindrical surface 368. Both the lobe and the cylindrical surface are disposed beneath the pawl and the pawl does or does not rest upon the lobe depending upon the rotational position of the lift arm. Four bolts 370 extend through apertures 372 in housing 336 and through apertures 374 in housing 334 for engagement with nuts 376 to secure the housing to one another. Housing 334 is essentially a mirror image of housing 336. That is, lift arm 168 is mounted upon shaft 152 and extends into slot 354 to selectively pivotally reposition pawl 378 pivotally secured within the slot by bolt 356 and biased by spring 354, as described above. Housing 334 also includes four passageways 340, 342, 344 and 346 for receiving a respective one of springs 348 that bear against brake shoe 328 and are compressed by respective ones of set screws 350.

Without the lift arm, both pawls could simultaneously engage the detent of the corresponding cam because of the differing speed of rotation of the roller and the set of pulleys during extension/retraction of the cover. To absolutely prevent such occurrence, one or the other lift arm, depending on the direction of rotation of the clutch, alternatively raises its associated pawl out of the corresponding slot and out of any contact with the underlying cam.

As described above, two cams, 310, 316, are rigidly secured to set of pulleys 78 and spindle 176, respectively. An end view of these cams is illustrated in FIG. 8 and collectively identified by numeral 380. The cam includes a central aperture 382 for penetrably receiving shaft 152. A bearing or bearing surface may be formed as part of aperture 382 depending upon whether the cam is to be in contact with the shaft. Cam 380 includes a plurality of apertures 384 for penetrable engagement with either bolts 312 or bolts 318. The exterior surface of the cam is essentially cylindrical but includes a detent 386 to capture the respective pawl when such pawl is not raised by the lobe of the corresponding lift arm.

Figure 9:
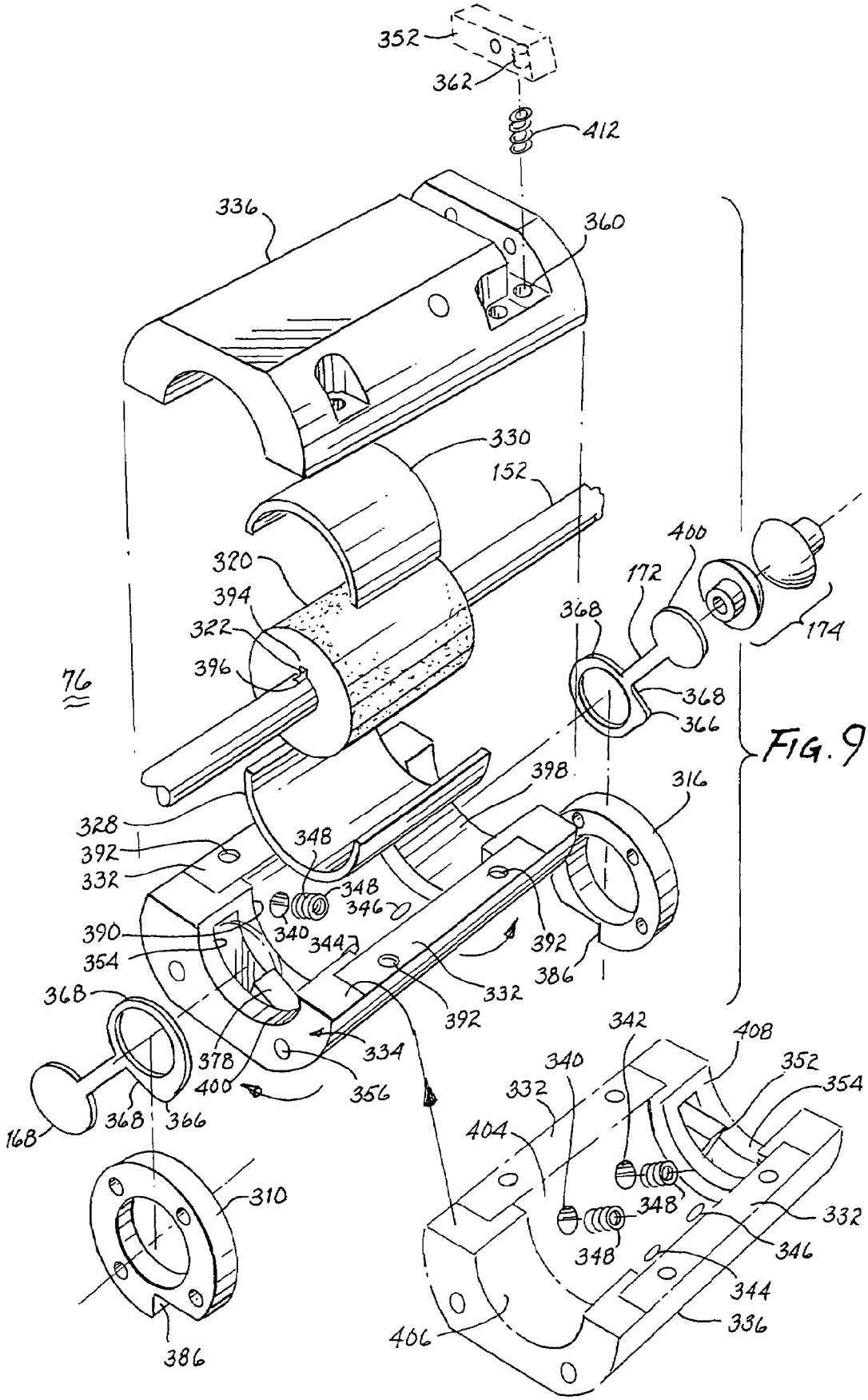
FIG. 9 is an exploded view of the clutch.

Certain details of the clutch not clearly shown in FIG. 8 will be described with reference to FIG. 9. Housing 334 includes a semi-cylindrical indentation 390 for receiving brake shoe 328. As illustrated, bars 332 are secured to housing 334 by machine screws 392 or the like. Each of the bars extends across a part of indentation 390 to capture brake shoe 328 and to prevent its rotation independent of the housing. As illustrated, springs 348 are lodged within the respective one of cavities 340, 342, 344 and 346 and extend into indentation 390 to bear against brake shoe 328. By turning set screws 350, the amount of force exerted upon the brake shoe is adjustable whereby the degree of friction between the brake shoe and the cylinder can be adjusted to control the degree of slippage between clutch 76 and shaft 152. As illustrated in further detail, key 322 interconnects a keyway 394 in cylinder 320 and a keyway 376 in shaft 152 to preclude relative rotation between the cylinder and the shaft. Housing 334 includes a semi-cylindrical cavity 398 for accommodating rotation of cam 316 therein. A further semi-cylindrical cavity 400 disposed at the other end of housing 334 accommodates rotation of cam 310 therewithin and slot 354 extends into the semi-cylindrical cavity. As illustrated, pawl 378 is located within slot 354 and extends into cavity 400 upon urging of spring 355 (see FIG. 8). The pawl pivots about bolt 356 extending into the housing. Lift arm 168 is mounted upon shaft 152 and lobe 366 and surface 368 bear against pawl 378 as a function of the rotational position of the lift arm relative to housing 334. In particular, when lobe 366 contact pawl 378, it forces the pawl to pivot out of cavity 400. Upon such pivoting, the pawl cannot come into engagement with detent 386 of cam 310. Housing 336 is shown twice in FIG. 9 to permit further illustration of both the interior and exterior configurations of the housing. This housing also includes bars 332 for capturing brake shoe 330 within indentation 404. Springs 348 extend from within cavities 340, 342, 344 and 346 and bear against brake shoe 330 to bias the brake shoe against the surface of cylinder 320. A cylindrical cavity 406 accommodates rotation of cam 310 therein. A further semi-cylindrical cavity 408 accommodates rotation of cam 316 therein and slot 354 extends to this cavity. Pawl 352 is rotatably mounted within the slot by bolt 356 and extends into cavity 408 for engagement with detent 386 of cam 316 unless the cam is biased into the slot by lobe 366 of lift arm 172. Set of spring loaded buttons 174 are illustrated and cooperate with lift arm 172. That is, as clutch 76 rotates in response to rotation of shaft 152, roundel 410 of the lift arm will pass between set of spring loaded buttons 174 upon each revolution. Upon passing between the buttons, the frictional engagement between roundel 410 and the spring loaded buttons will urge the lift arm to be pivotally retarded and pivot to its limit. Depending upon the direction of rotation of clutch 76 and the relative position of the lift arm therewith, the lift arm may or may not pivot. Such pivotal movement, if it occurs, will or will not bring lobe 366 into contact with pawl 352. If the lobe is not in contact with pawl 352, the pawl will extend into cavity 408, as illustrated. Such extension will result in the pawl engaging detent 386 of cam 316 and cause rotation of the cam commensurate with rotation of clutch 76. As the cam is attached to the spindle attendant the roller, the roller will rotate commensurately. When lobe 366 comes into contact with pawl 352, the pawl will be pivoted into the slot and no longer extend into cavity 408. In such event, the pawl will not contact cam 316 and no rotational force will be imparted by clutch 76 to the cam and attached spindle/roller. As noted in the upper view of housing 336, a spring 412 extends into cavity 360 in the housing and into cavity 362 in pawl 352 to bias the free end of the pawl through the slot into cavity 408, as depicted in the bottom view of housing 336.

Figure 10:
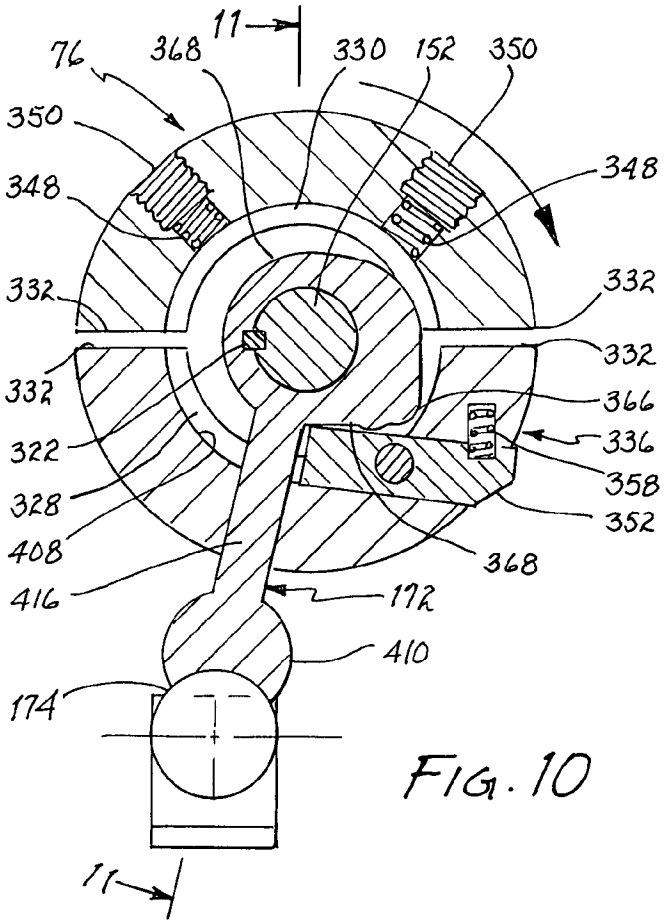
FIGS. 10 and 11 are partial cross sectional views illustrating operation of a lift arm and the associated pawl.
Figure 11:
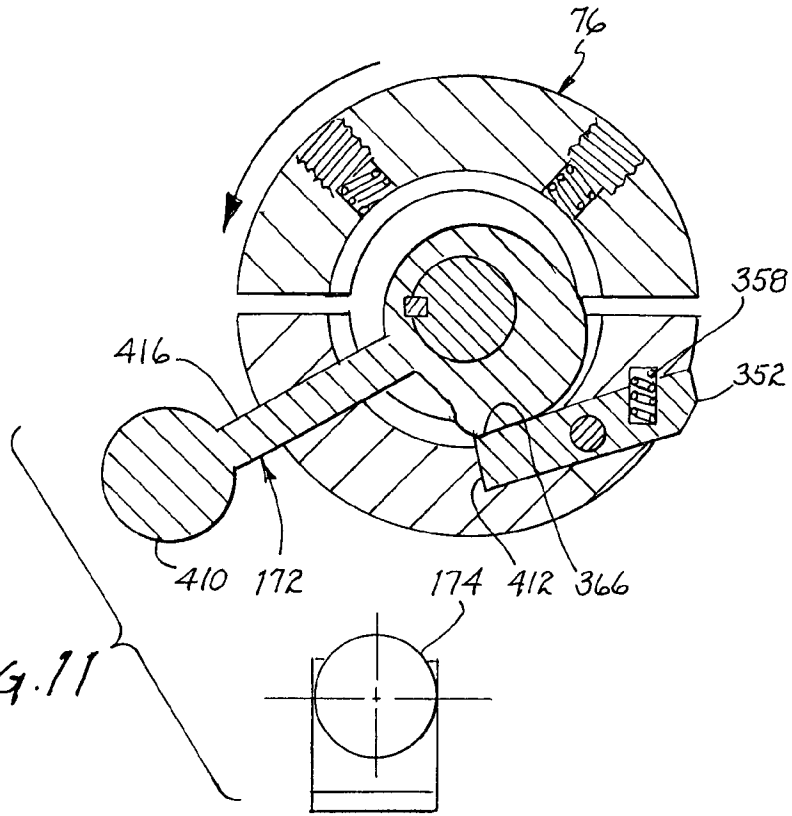

Referring jointly to FIGS. 10 and 11, the action of the lift arms relative to the spring loaded buttons will be described in detail. As clutch 76 rotates clockwise, as shown in FIG. 10, roundel 410 of lift arm 172 will come into frictional contact with set of spring loaded buttons 174. This will tend to retard the lift arm from rotation relative to the clutch and lobe 366 will either brought out of engagement with pawl 352 or remain unengaged with the pawl (as illustrated); the pawl will be supported by surface 368. Surface 368, between lobe 366 and arm 416 is sufficiently close to the center of rotation to permit the pawl to extend into cavity 408 of housing 336. This position of pawl 352, urged by spring 358, will cause the pawl to engage detent 386 of cam 316 (see FIGS. 8 and 9).

As clutch 76 rotates in the other direction, as shown in FIG. 11, roundel 410 will engage spring loaded buttons 174 and upon contact therewith urge the lift arm to pivot in the other direction. Such rotation of the lift arm will result in lobe 366 bearing against the side of pawl 352 and cause the pawl to pivot essentially out of cavity 408. With the pawl being removed from within cavity 408, it cannot contact detent 386 of adjacent cam 316. For purposes of clarity, many of the reference numerals shown in FIG. 10 have been eliminated from FIG. 11 as they are duplicative and clearly shown in FIG. 10. When the clutch is caused to rotate in the other direction, as shown in FIG. 10, lift are 172 is again repositioned and lobe 366 no longer bears against the pawl and the pawl will be urged into cavity 408 for engagement with the detent of the adjacent cam. While only one side of clutch 76 has been illustrated in FIGS. 10 and 11, it is to be understood that the other side of the clutch and its lift arm and cam operate in the same manner.

Figure 12:
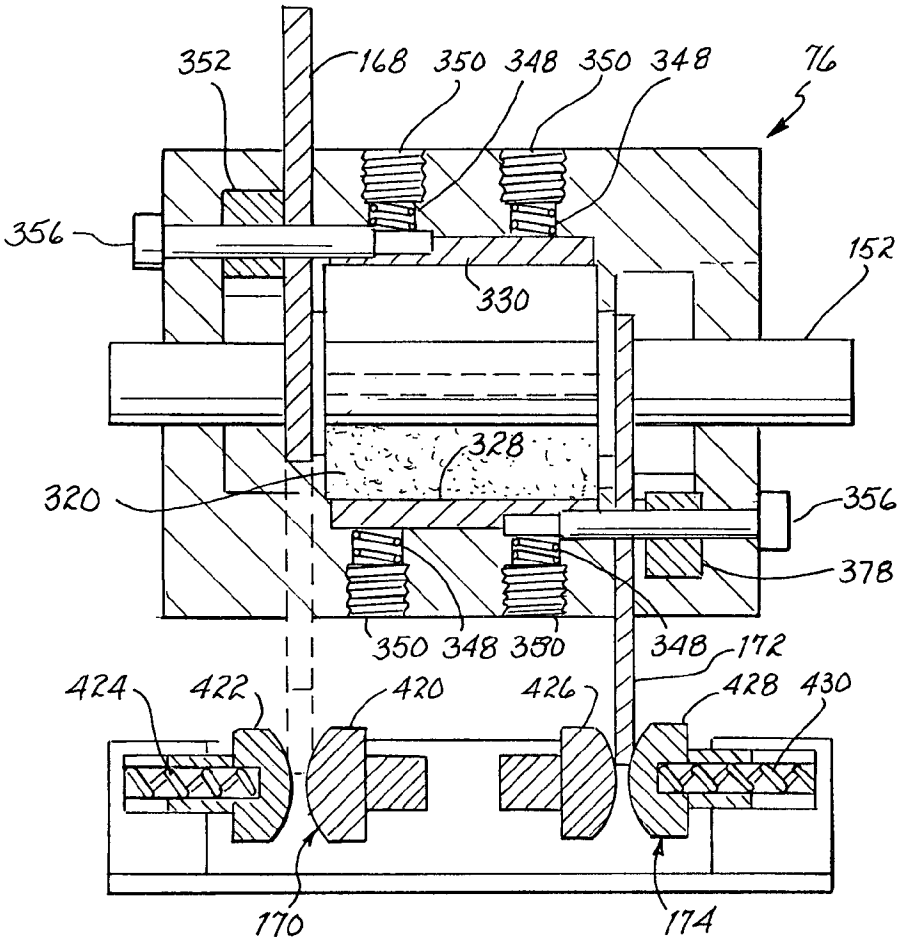
FIG. 12 illustrates the lift arms extending from the clutch and the spring loaded buttons frictionally engaging the lift arms.
Figure 13:
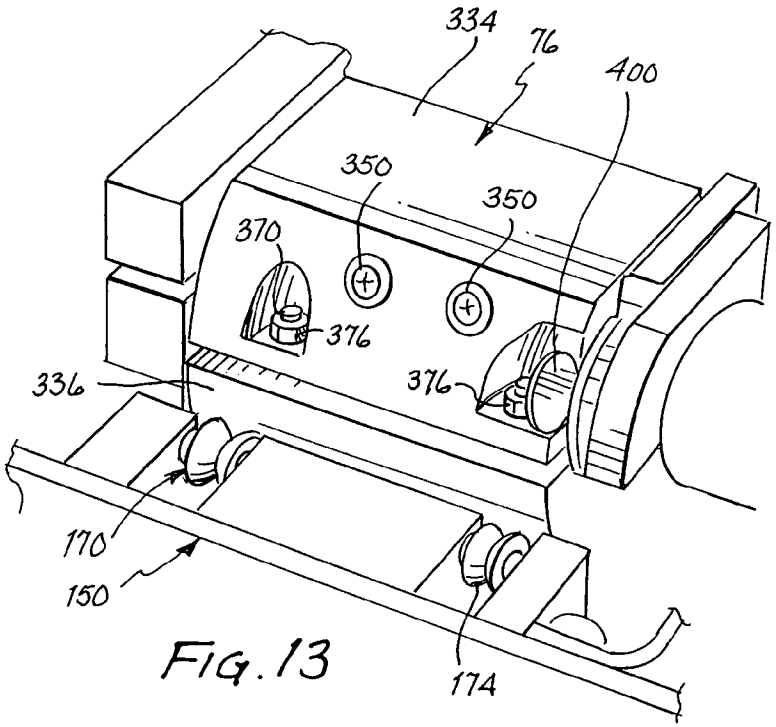
FIG. 13 is a partial isometric view illustrating view illustrating the clutch, a lift arm and the spring loaded buttons.

Partial cross sectional view shown in FIG. 12 and the isometric view shown in FIG. 13 illustrate further details of the operation of the lift arms to alter the position of each of the two pawls that cause either, but not both, cams 310 and 316 to be rotated and result in rotation of the respective set of pulleys 78 or spindle 176 extending from the roller. Set of spring loaded buttons 170 include a positionally fixed button 420 and a translatable button 422 urged toward button 420 by a spring 424. Preferably, buttons 420 and 422 are of low-wear plastic material that creates sufficient friction when the roundel of the lift arm passes there between to urge incremental pivotal movement of the lift arm. Similarly, set of spring loaded buttons 174 includes a fixed button 426 and a translatable button 428 urged toward button 426 by spring 430.

As illustrated when shaft 152 rotates resulting in commensurate rotation of clutch 76, each of lift arms 168, 172 will contact the respective set of spring loaded buttons 170, 174 upon each revolution, irrespective of the direction of rotation of the shaft and the respective lift arm will be urged to pivot. When shaft 152 and clutch 76 rotate continuously in one direction, only one or another of lift arms 168, 172 will be urged into pivotal movement to engage a respective lobe 368 with the respective pawl to pivot the pawl into the respective semi-cylindrical cavity and into engagement with the detent of an adjacent cam. When the direction of rotation changes, the position of the two lift arms will be reversed. Thereby, the lobe of the lift arm formerly in engagement with its pawl will become out of engagement and the previously non engaged lobe of the other lift arm will become engaged with its pawl. Thus, only one or the other of the adjacent cams will be caused to rotate by the force exerted by the respective pawl. As particularly shown in FIG. 13, sets of spring loaded buttons 170, 174 are mounted to elements of frame 150 for engagement with the respective one of the lift arms through its roundel.

I claim:

1. An apparatus for extending and retracting a cover for a pool, said apparatus comprising in combination:

a) a roller for wrapping the cover thereabout during retraction and for extending the cover therefrom during extension;

b) a motor selectively rotatable in one direction for extending the cover and in the other direction for retracting the cover;

c) a set of pulleys for wrapping a pair of cords thereabout, which cords are attached to the edge of the cover, in response to rotation of said motor in the one direction and for accommodating unwrapping the pair of cords from thereabout in response to rotation of said motor in the other direction;

d) a clutch for selectively interconnecting in the alternative said roller and said set of pulleys;

e) said clutch including a first pawl acting upon a first cam for engaging said set of pulleys upon rotation of said motor in the one direction and a second pawl acting upon a second cam engaging said roller upon rotation of said motor in the other direction whereby either said set of pulleys and said roller is caused to rotate as a function of the direction of rotation of said motor, a shaft coupled with said motor, a cylinder non rotatably mounted upon said shaft, a pair of opposed brake shoes for engaging said cylinder and adjustable springs for setting the amount of friction between said cylinder and said pair of brake shoes, a first lift arm having a lobe and being positionable to a first position for pivoting said first pawl out of engagement with said first cam and a second lift arm having a lobe and being positionable to a first position for pivoting said second pawl out of engagement with said second cam, a first slidably engageable element for engaging said first lift arm to relocate and repetitively maintain said first lift arm in the first position upon rotation of said motor in the one direction and a second slidably engageable element for engaging said second lift arm to relocate and repetitively maintain said second lift arm in the first position upon rotation of said motor in the other direction.

2. The apparatus as set forth in claim 1, including a compensator for accommodating a change in length over time of one of said cords relative to the other of said cords.

3. The apparatus as set forth in claim 1, including a compensator for accommodating a difference in length of one of said cords relative to the other of said cords as a function of lack of squareness of the pool.

4. The apparatus as set forth in claim 1, wherein said clutch includes a shaft coupled with said motor, a cylinder non rotatably mounted upon said shaft, a pair of opposed brake shoes for engaging said cylinder and adjustable springs for setting the amount of friction between said cylinder and said pair of brake shoes.

5. An apparatus for extending and retracting a cover for a pool, said apparatus comprising in combination:

a) a roller for wrapping the cover thereabout during retraction and for extending the cover therefrom during extension;

b) a motor selectively rotatable in one direction for extending the cover and in the other direction for retracting the cover;

c) a set of pulleys for wrapping a pair of cords thereabout, which cords are attached to the edge of the cover, in response to rotation of said motor in the one direction and for accommodating unwrapping the pair of cords from thereabout in response to rotation of said motor in the other direction;

d) a compensator for accommodating a change in length over time of one of said cords relative to the other of said cords;

e) a clutch for selectively interconnecting in the alternative said roller and said set of pulleys;

f) said clutch including a first pawl acting upon a first cam for engaging said set of pulleys upon rotation of said motor in the one direction and a second pawl acting upon a second cam engaging said roller upon rotation of said motor in the other direction whereby either said set of pulleys and said roller is caused to rotate as a function of the direction of rotation of said motor, a shaft coupled with said motor, a cylinder non rotatably mounted upon said shaft, a pair of opposed brake shoes for engaging said cylinder and adjustable springs for setting the amount of friction between said cylinder and said pair of brake shoes, a first lift arm having a lobe and being positionable to a first position for pivoting said first pawl out of engagement with said first cam and a second lift arm having a lobe and being positionable to a first position for pivoting said second pawl out of engagement with said second cam, a first slidably engageable element for engaging said first lift arm to relocate and repetitively maintain said first lift arm in the first position upon rotation of said motor in the one direction and a second slidably engageable element for engaging said second lift arm to relocate and repetitively maintain said second lift arm in the first position upon rotation of said motor in the other direction.

6. A method for extending and retracting a cover for a pool, said method comprising the steps of:

a) wrapping and unwrapping a cover about a roller to retract and to extend the cover across the pool;

b) rotating the roller in one direction to wrap the cover thereabout and rotating a set of pulleys in the other direction to draw cords attached to the edge of the cover and unwrap the cover from about the roller;

c) selectively engaging a motor through a clutch with either the roller or the set of pulleys;

d) engaging a first cam associated with the set of pulleys with a first pawl pivotally mounted in the clutch to urge rotation of the set of pulleys in the one direction;

e) further engaging a second cam associated with the roller with a second pawl pivotally mounted in the clutch to urge rotation of the cover in the other direction; and f) urging rotation of the clutch in the one direction or in the other direction with a cylinder mounted on a shaft associated with a motor and spring loaded brake shoes mounted within the clutch and in contact with the cylinder.

7. The method as set forth in claim 6, including the step of repositioning the first pawl into and out of engagement with the first cam as a function of the direction of rotation of the clutch and the step of further repositioning the second pawl into and out of engagement with the second cam as a function of the direction of rotation of the clutch.

8. The method as set forth in claim 6, including the step of compensating for a change in length of one of the cords relative to the other of the cords.

9. The method as set forth in claim 7, including the step of compensating for a change in length of one of the cords relative to the other of the cords.

10. Apparatus for extending and retracting a cover across a pool, said apparatus comprising in combination:

a) a roller for supporting the cover;

b) a motor having an armature for selectively rotating said roller in one direction to wrap the cover thereabout;

c) a set of pulleys for selectively winding a pair of cords thereon to extend the cover from said roller across the pool;

d) a clutch in operative engagement with said motor to selectively rotate one of said roller and said set of pulleys as a function of the direction of rotation of said motor;

e) said clutch including:

i) a first cam operatively engaged by a first pawl for causing rotational engagement of said set of pulleys with said motor and a first lift arm for selectively disengaging said first pawl with said first cam as a function of the direction of rotation of said motor;

ii) a second cam operatively engaged by a second pawl for causing rotational engagement of said roller with said motor and a second lift arm for selectively disengaging said second pawl with said second cam as a function of the direction of rotation of said motor; and iii) a compensator for compensating for uneven elongation of the lengths of the cords of said pair of cords.

11. The apparatus as set forth in claim 10, including a first contact for momentarily engaging said first lift arm and a second contact for momentarily engaging said second lift arm as a function of rotation of said clutch.

12. The apparatus as set forth in claim 11 wherein said first lift arm includes a first lobe for pivoting and maintaining said first pawl out of engagement with said first cam and wherein said second lift arm includes a second lobe for pivoting and maintaining said second pawl out of engagement with said second cam.

13. The apparatus as set forth in claim 12 wherein said first contact includes a first pair of spring loaded buttons for exerting a friction force on said first lift arm passing there between and wherein said second contact includes a second pair of spring loaded buttons for exerting a friction force on said second lift arm passing there between.

14. The apparatus as set forth in claim 10 including a shaft coupled with said armature of said motor, said clutch including a cylinder mounted upon said shaft, at least one brake shoe coupled with said clutch and bearing against said cylinder for imparting rotary motion of said cylinder to said clutch.

15. The apparatus as set forth in claim 14 wherein said at least one brake shoe comprises a pair of opposed brake shoes.

16. The apparatus as set forth in claim 15, including an adjustable spring loading exertable upon each brake shoe of said pair of brake shoes.

17. The apparatus as set forth in claim 14 wherein said first cam is mechanically coupled with said set of pulleys and including a spindle attached to said roller and wherein said second cam is mechanically coupled with said spindle.

18. The apparatus as set forth in claim 17 wherein said axle extends through the center of said set of pulleys.

19. The apparatus as set forth in claim 10 wherein a first cord of said pair of cords extends from a first pulley of said set of pulleys about a spool, through a passageway within said compensator to a further spool, into said compensator, about a first pulley within said compensator to reverse direction and attached to one end at the edge of said cover and wherein a second cord of said pair of cords extends from a second pulley of said set of pulleys about a yet further spool, into said compensator, about a second pulley within said compensator to reverse direction, about a yet further spool to reverse direction and attached to the other end at the edge of said cover.

20. The apparatus as set forth in claim 19, including at least a pair of spools for guiding said first cord from said first pulley to said one end at the edge of said cover and at least a pair of further spools for guiding said second cord from said yet further spool to said other end at the edge of said cover.

21. A pool cover extension and retraction apparatus, said apparatus comprising in combination:

a) a pool cover adapted to be drawn across a pool;

b) a pulley and cord mechanism for drawing said pool cover across the pool;

c) roller for supporting said pool cover thereabout;

d) an electric motor coupled to an output shaft for selectively rotating in a first and a second direction to actuate in the alternative at least one pulley to wind at least one cord thereabout during extension of said pool cover across the pool and a roller for wrapping said pool cover thereabout during retraction of said pool cover from across the pool;

e) a clutch assembly mounted on said output shaft, said clutch assembly including a cylinder rigidly supported on said output shaft, a spring loaded clutch in frictional engagement with said cylinder, and first and second pawls pivotally mounted on said clutch;

f) a first cam attached to said at least one pulley, said first cam including a detent for capturing said first pawl when said clutch assembly rotates in the first direction to cause said at least one pulley to wind the cord(s) of said pulley and cord mechanism thereabout;

g) a second cam attached to said roller, said second cam including a detent for capturing said second pawl when said clutch assembly rotates in the second direction to cause said roller to wrap said pool cover thereabout;

h) said first cam being freewheeling relative to said first pawl in response to pivotal movement of a first lift arm upon rotation of said clutch assembly in the second direction to accommodate unwinding of said cord from said at least one pulley; and i) said second cam being freewheeling relative to said second pawl in response to pivotal movement of a second lift arm upon rotation of said clutch assembly in the first direction to accommodate unwrapping of said pool cover from about said roller.

* * * * *